US008702954B2

(12) United States Patent
Kubota

(10) Patent No.: US 8,702,954 B2
(45) Date of Patent: Apr. 22, 2014

(54) MANUFACTURING METHOD FOR SURFACE-TREATED METALLIC SUBSTRATE AND SURFACE-TREATED METALLIC SUBSTRATE OBTAINED BY SAID MANUFACTURING METHOD, AND METALLIC SUBSTRATE TREATMENT METHOD AND METALLIC SUBSTRATE TREATED BY SAID METHOD

(75) Inventor: Kentaro Kubota, Hiratsuka (JP)

(73) Assignee: Kansai Paint Co., Ltd., Hyogo (JP)

( * ) Notice: Subject to any disclaimer, the term of this patent is extended or adjusted under 35 U.S.C. 154(b) by 942 days.

(21) Appl. No.: 12/809,740

(22) PCT Filed: Dec. 17, 2008

(86) PCT No.: PCT/JP2008/072938

§ 371 (c)(1),
(2), (4) Date: Jun. 21, 2010

(87) PCT Pub. No.: WO2009/081807

PCT Pub. Date: Jul. 2, 2009

(65) Prior Publication Data

US 2010/0270164 A1 Oct. 28, 2010

(30) Foreign Application Priority Data

Dec. 21, 2007 (JP) ..... 2007-330365

(51) Int. Cl.
*C25D 9/08* (2006.01)

(52) U.S. Cl.
USPC ..... 205/108; 205/106; 205/170; 205/316

(58) Field of Classification Search
USPC ..... 205/104, 108
See application file for complete search history.

(56) References Cited

U.S. PATENT DOCUMENTS

| | | | | | |
|---|---|---|---|---|---|
| 2,706,170 | A | * | 4/1955 | Marchese | 205/67 |
| 3,716,464 | A | * | 2/1973 | Kovac et al. | 205/259 |
| 3,984,299 | A | | 10/1976 | Jerabek | |
| 4,017,438 | A | | 4/1977 | Jerabek et al. | |
| 4,159,231 | A | * | 6/1979 | Smith et al. | 205/107 |
| 5,618,634 | A | * | 4/1997 | Hosoda et al. | 428/610 |
| 5,871,630 | A | * | 2/1999 | Bhattacharya et al. | 205/192 |

(Continued)

FOREIGN PATENT DOCUMENTS

| | | |
|---|---|---|
| JP | 49-1443 | 1/1974 |
| JP | 59-43013 | 3/1984 |

(Continued)

OTHER PUBLICATIONS

International Search Report issued Apr. 14, 2009 in International (PCT) Application No. PCT/JP2008/072938.

*Primary Examiner* — Bryan D. Ripa
(74) *Attorney, Agent, or Firm* — Wenderoth, Lind & Ponack, L.L.P.

(57) ABSTRACT

The object of the present invention is to provide a process for producing a metal substrate of superior corrosion resistance and finish, and a surface-treated metal substrate obtained by the process; and a surface treatment process that is capable of providing a metal substrate of superior corrosion resistance and finish, and a surface-treated metal substrate obtained by the process. Specifically, the present invention provides a process for producing a surface-treated metal substrate, comprising the steps of immersing a metal substrate for use as a cathode in a treatment composition (I) comprising water and metal component (A), and applying electric current thereto for 10 to 600 seconds by superposing an AC voltage (Va) with a frequency of 0.1 to 1,000 Hz and a peak-to-peak voltage of 1 to 40 V onto a 1 to 50 V DC voltage (Vd).

4 Claims, 1 Drawing Sheet

(56) References Cited

U.S. PATENT DOCUMENTS

| | | | | |
|---|---|---|---|---|
| 2003/0075453 | A1* | 4/2003 | Dolan | 205/324 |
| 2004/0244875 | A1 | 12/2004 | Yasuda et al. | |
| 2006/0275953 | A1 | 12/2006 | Ogihara | |

FOREIGN PATENT DOCUMENTS

| | | |
|---|---|---|
| JP | 4-193997 | 7/1992 |
| JP | 6-330385 | 11/1994 |
| JP | 9-249990 | 9/1997 |
| JP | 2001-26896 | 1/2001 |
| JP | 2005-23422 | 1/2005 |
| JP | 2005-325401 | 11/2005 |
| JP | 2006-9086 | 1/2006 |
| JP | 2006-57135 | 3/2006 |
| JP | 2006-336079 | 12/2006 |

* cited by examiner

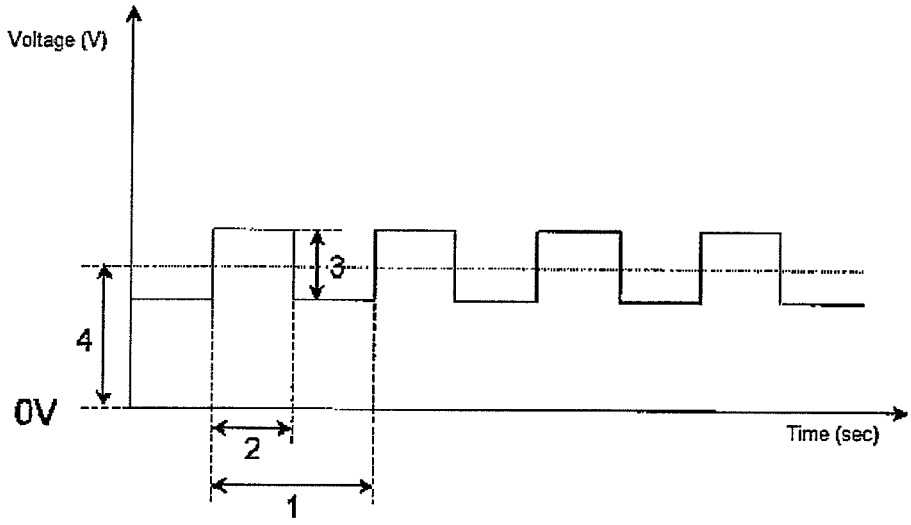
Voltage (V)
3
4
0V
2
1
Time (sec)

MANUFACTURING METHOD FOR SURFACE-TREATED METALLIC SUBSTRATE AND SURFACE-TREATED METALLIC SUBSTRATE OBTAINED BY SAID MANUFACTURING METHOD, AND METALLIC SUBSTRATE TREATMENT METHOD AND METALLIC SUBSTRATE TREATED BY SAID METHOD

TECHNICAL FIELD

The present invention relates to a process for producing a surface-treated metal substrate, a surface-treated metal substrate obtained by the process, and a process for treating a metal substrate, and a metal substrate treated by the process.

BACKGROUND ART

Conventionally, in the industrial coating line, a chromate treatment, a zinc phosphate treatment, and the like are used as an undercoating treatment, to improve the corrosion resistance and adhesion of metal substrates. However, these methods are problematic as they involve environmentally harmful components, generate waste sludge etc. Therefore, as a replacement for the chromate treatment and the zinc phosphate treatment, methods using a chemical conversion treatment composition containing a titanium compound or a zirconium compound have been put into practical use.

In these surface treatment methods, zirconium/titanium hydroxide, zirconium/titanium fluoride, and the like are deposited on the surface of a metal substrate, which allows the production of a film that is highly protective against corrosion-causing substances. However, metal ions that are eluted from the metal substrate problematically cause a bath containing a chemical conversion treatment composition to become unstable; and further, in order to achieve adequate corrosion resistance after coating, a relatively long treatment time is required, the bath temperature for surface treatment must be kept at relatively high temperatures, etc., which hinders improvement in energy conservation and productivity.

Known chemical conversion treatments using a zirconium compound-containing chemical conversion treatment composition include a metal surface treatment method comprising the step of forming a chemical conversion coating on the surface of a metal article to be treated, by a chemical conversion treatment reaction using a chemical conversion treatment composition containing a zirconium-containing compound and a fluorine-containing compound, the method being characterized in that the chemical conversion treatment reaction is conducted through a cathodic electrolysis treatment (see, for example, Patent Document 1). Known methods of a zinc or zinc-based alloy-plated steel surface treatment include those comprising the step of forming a chemical conversion coating on the surface of a metal article to be treated, by a chemical conversion treatment reaction using a chemical conversion treatment composition that contains at least one member selected from the group consisting of zirconium-containing compounds, fluorine-containing compounds, aluminum ions, vanadium ions, and magnesium ions, the method being characterized in that the chemical conversion treatment reaction is conducted through cathodic electrolysis treatment (see, for example, Patent Document 2).

However, the surface treatment methods disclosed in Patent Documents 1 and 2 have problems in that uniform chemical conversion coatings are difficult to form, and that films obtained by coating with these coating compositions exhibit neither adequate corrosion resistance nor adequate finish.

Patent Document 3 teaches an electrodeposition coating method in which a coating film defect referred to as "gas pin holes" can be controlled by superposing a pulse voltage. Patent Document 3, however, is directed to coating with an electrodeposition coating composition; in contrast, the present application relates to a metal substrate treatment process in which the surface of a metal substrate is treated using a specific treatment composition. Accordingly, the compositions and effects are completely different therebetween.

Patent Document 1:
Japanese Unexamined Patent Publication No. 2005-23422
Patent Document 2:
Japanese Unexamined Patent Publication No. 2005-325401
Patent Document 3:
Japanese Unexamined Patent Publication No. 2006-9086

DISCLOSURE OF THE INVENTION

Problems to be Solved by the Invention

The object of the present invention is to provide a process for producing a metal substrate that is excellent in corrosion resistance and finish after coating, and a surface-treated metal substrate obtained by the process; and a surface-treatment process that is capable of providing a metal substrate of superior corrosion resistance and finish after coating, and a metal substrate surface-treated by the process.

Means for Solving the Problems

The present inventors conducted extensive research. As a result, they found that the above object can be achieved by immersing a metal substrate for use as a cathode in a specific treatment composition (I), and applying an electric current thereto for 10 to 600 seconds by superposing an AC voltage (Va) with a frequency of 0.1 to 1,000 Hz and a peak-to-peak voltage of 1 to 40 V onto a 1 to 50 V DC voltage (Vd). The present invention was thus accomplished.

Specifically, the present invention is as follows:

1. A process for producing a surface-treated metal substrate, comprising the steps of:

immersing a metal substrate as a cathode in a treatment composition (I) described below, and applying electric current for 10 to 600 seconds by superposing an AC voltage (Va) with a frequency of 0.1 to 1,000 Hz and a peak-to-peak voltage of 1 to 40 V onto a 1 to 50 V DC voltage (Vd), the treatment composition (I) comprising water and a metal compound component (A) comprising one or more compound of at least one metal (a), wherein the metal (a) is selected from the group consisting of zirconium, titanium, cobalt, vanadium, tungsten, molybdenum, copper, zinc, indium, bismuth, yttrium, iron, nickel, manganese, gallium, silver, and lanthanide metals, the metal compound component (A) being contained in an amount of 5 to 20,000 ppm, calculated as a total quantity of metal, on a mass basis.
2. The process according to Item 1, wherein the waveform of the AC voltage (Va) is rectangular.
3. The process according to Item 1 or 2, wherein the duty cycle of the AC voltage (Va) is 0.1 to 0.9.
4. A surface-treated metal substrate obtained by the process according to any one of Items 1 to 3.

5. A process for surface-treatment of a metal substrate comprising the steps of:

immersing a metal substrate as a cathode in a treatment composition (I) described below, and applying electric current thereto for 10 to 600 seconds by superposing an AC voltage (Va) with a frequency of 0.1 to 1,000 Hz and a peak-to-peak voltage of 1 to 40 V onto a 1 to 50 V DC voltage (VD), the treatment composition (I) comprising water and a metal compound component (A) comprising one or more compound of at least one metal (a), wherein the metal (a) is selected from the group consisting of zirconium, titanium, cobalt, vanadium, tungsten, molybdenum, copper, zinc, indium, bismuth, yttrium, iron, nickel, manganese, gallium, silver, and lanthanide metals, the metal compound component (A) being contained in an amount of 5 to 20,000 ppm, calculated as a total quantity of metal, on a mass basis.

6. A metal substrate surface-treated by the process according to Item 5.

7. A coated article, which comprises the substrate according to Item 4 or 6.

Effects of the invention

The surface-treated metal substrate production process and the metal substrate surface treatment process according to the present invention provide the following effects.

(1) A surface-treated metal substrate having superior corrosion resistance and finish after coating can be obtained in a short period of treatment, compared to an electrolytic treatment using a conventional cathode electrolytic method (direct-current electrolytic method). Accordingly, productivity is improved (improvement of takt time).

(2) In the production process and the treatment process of the present invention, when an AC voltage (Va) is applied onto the metal substrate under cathode bias (also referred to as an "offset voltage" and corresponding to a DC voltage (Vd)), the surface of the metal substrate is activated, which allows uniform formation of treated film generated by an electrolytic treatment. Accordingly, coated articles obtained by applying a coating composition on a metal substrate with a uniform treated film have superior corrosion resistance and finish.

(3) The resulting treated film is a uniform, high-dense film (several tens or hundreds of nm) with few cracks. Since this film can block corrosion-promoting substances (e.g., $O_2$, $Cl^-$, $Na^+$), corrosion of the metal substrate under the coating film can be inhibited.

(4) By carrying out an electrolytic treatment using AC voltage, only a metal component that is capable of forming an oxide film (for example, fluorozirconium complex ion) can be deposited on a cathode (selective deposition of a metal component is possible). For this reason, it is considered that a film containing a high-purity metal oxide is formed on the metal substrate.

The production process of the film of the present invention will be explained in detail below.

DESCRIPTION OF THE DRAWINGS

FIG. 1 shows a model structure that represents the voltage conditions used in the metal substrate treatment process of the present invention.

EXPLANATION OF REFERENCE NUMERALS

1. Period (T)
2. Pulse duration (τ)
3. Peak-to-peak voltage
4. Direct voltage (Vd)

BEST MODE FOR CARRYING OUT THE INVENTION

1. Surface-Treated Metal Substrate Production Process

The present invention relates to a process for producing a surface-treated metal substrate comprising the steps of immersing a metal substrate for use as a cathode in a treatment composition (I), and applying electric current thereto for 10 to 600 seconds by superposing an AC voltage (Va) with a frequency of 0.1 to 1,000 Hz and a peak-to-peak voltage of 1 to 40 V onto a 1 to 50 V DC voltage (Vd).

1.1 Metal Substrate

The metal substrate for use in the process of the present invention is not particularly limited. For example, cold-rolled steel sheets, hot dip galvanized steel sheets, electro-galvanized steel sheets, electrolytic zinc-iron duplex plated steel sheets, organic composite plated steel sheets, aluminium alloys, magnesium alloys, and the like are usable. If necessary, the surface of the metal substrate may be washed using alkali degreasing etc.

1.2 Treatment Composition (I)

The treatment composition (I) for use in the process of the present invention comprises water and a metal compound component (A) comprising one or more compound of at least one metal (a), wherein the metal (a) is selected from the group consisting of zirconium, titanium, cobalt, vanadium, tungsten, molybdenum, copper, zinc, indium, bismuth, yttrium, iron, nickel, manganese, gallium, silver, and lanthanide metals (lanthanum, cerium, praseodymium, neodymium, samarium, europium, gadolinium, terbium, dysprosium, holmium, erbium, thulium, ytterbium, and lutetium).

The treatment composition (I) contains, as the total quantity of metal (on a mass basis), the metal compound component (A) in an amount of 5 to 20,000 ppm, preferably 20 to 10,000 ppm, more preferably 50 to 5,000 ppm, even more preferably 80 to 1,000 ppm, and most preferably 100 to 500 ppm. When the amount of the metal compound component (A) is below 5 ppm, corrosion resistance and exposure resistance tend to decrease, whereas when the amount of the metal compound component (A) exceeds 20,000 ppm, the stability of the treatment composition tends to decrease.

Compounds of the metal (a), which are usable in the metal compound component (A), generate metal (a)-containing ions.

Zirconium compounds are compounds that generate zirconium-containing ions, such as zirconium ions, oxyzirconium ions, fluorozirconium ions, and the like.

Examples of oxyzirconium ion-generating compounds include zirconyl nitrate, zirconyl acetate, zirconyl sulfate, etc. Examples of fluorozirconium ion-generating compounds include zirconium hydrofluoric acid, sodium zirconium fluoride, potassium zirconium fluoride, lithium zirconium fluoride, ammonium zirconium fluoride, etc. Of these, zirconyl nitrate and ammonium zirconium fluoride are particularly preferred.

Examples of titanium compounds include titanium ion-generating compounds, fluorotitanium ion and like titanium-containing ion-generating compounds, etc.

Examples of titanium ion-generating compounds include titanium chloride, titanium sulfate, etc. Examples of fluorotitanium ion-generating compounds include titanium hydrofluoric acid, sodium titanium fluoride, potassium titanium fluoride, lithium titanium fluoride, ammonium titanium fluoride, etc. Of these, ammonium titanium fluoride is particularly preferred.

Cobalt compounds are compounds that generate cobalt ions.

Examples of cobalt ion-generating compounds include cobalt chloride, cobalt bromide, cobalt iodide, cobalt nitrate, cobalt sulfate, cobalt acetate, ammonium cobalt sulfate, etc. Of these, cobalt nitrate is particularly preferred.

Vanadium compounds are compounds that generate vanadium ions.

Examples of vanadium ion-generating compounds include lithium orthovanadate, sodium orthovanadate, lithium metavanadate, potassium metavanadate, sodium metavanadate, ammonium metavanadate, sodium pyrovanadate, vanadyl chloride, vanadyl sulfate, etc. Of these, ammonium metavanadate is particularly preferred.

Tungsten compounds are compounds that generate tungsten ions.

Examples of tungsten ion-generating compounds include lithium tungstate, sodium tungstate, potassium tungstate, ammonium tungstate, sodium metatungstate, sodium paratungstate, ammonium pentatungstate, ammonium heptatungstate, sodium phosphotungstate, barium borotungstate, etc. Of these, ammonium tungstate and the like are particularly preferred.

Molybdenum compounds are compounds that generate molybdenum ions. Examples of molybdenum ion-generating compounds include lithium molybdate, sodium molybdate, potassium molybdate, ammonium heptamolybdate, calcium molybdate, magnesium molybdate, strontium molybdate, barium molybdate, phosphomolybdic acid, sodium phosphomolybdate, zinc phosphomolybdate, etc.

Copper compounds are compounds that generate copper ions. Examples thereof include copper sulfate, copper(II) nitrate trihydrate, copper(II) ammonium sulfate hexahydrate, copper (II) oxide, copper phosphate, etc.

Zinc compounds are compounds that generate zinc ions. Examples thereof include zinc acetate, zinc lactate, zinc oxide, etc.

Indium compounds are compounds that generate indium ions. Examples thereof include ammonium indium nitrate and the like.

Bismuth compounds are compounds that generate bismuth ions. Examples thereof include inorganic bismuth-containing compounds such as bismuth chloride, bismuth oxychloride, bismuth bromide, bismuth silicate, bismuth hydroxide, bismuth trioxide, bismuth nitrate, bismuth nitrite, bismuth oxycarbonate, etc.; and organic bismuth-containing compounds such as bismuth lactate, triphenylbismuth, bismuth gallate, bismuth benzoate, bismuth citrate, bismuth methoxyacetate, bismuth acetate, bismuth formate, bismuth 2,2-dimethylolpropionate, and the like.

Yttrium compounds are compounds that generate yttrium ions. Examples thereof include yttrium nitrate, yttrium acetate, yttrium chloride, yttrium sulfamate, yttrium lactate, yttrium formate, etc. Of these, yttrium nitrate and the like are particularly preferred.

Iron compounds are compounds that generate iron ions. Examples thereof include iron(II) chloride, iron(III) chloride, ammonium iron(III) citrate, ammonium iron(III) oxalate, iron(III) nitrate, iron(III) fluoride, iron(III) sulfate, ammonium iron(III) sulfate, etc.

Nickel compounds are compounds that generate nickel ions. Examples thereof include nickel(II) chloride, nickel(II) acetate, nickel(II) citrate, nickel(II) oxalate, nickel(II) nitrate, nickel(II) sulfamate, nickel(II) carbonate, nickel(II) sulfate, nickel(II) fluoride, etc.

Manganese compounds are compounds that generate manganese ions. Examples thereof include manganese(II) acetate, manganese(III) acetate, manganese(II) oxalate, manganese(II) nitrate, manganese(II) carbonate, manganese(II) sulfate, ammonium manganese(II) sulfate, etc.

Gallium compounds are compounds that generate gallium ions. Examples thereof include gallium nitrate and the like.

Silver compounds are compounds that generate silver ions. Examples thereof include silver(I) acetate, silver(I) chloride, silver(I) nitrate, silver(I) sulfate, etc.

Of lanthanide metal compounds, those that generate lanthanum ions include, for example, lanthanum nitrate, lanthanum fluoride, lanthanum acetate, lanthanum boride, lanthanum phosphate, lanthanum carbonate, etc.; those that generate cerium ions include, for example, cerium(III) nitrate, cerium(III) chloride, cerium(III) acetate, cerium(III) oxalate, ammonium cerium(III) nitrate, diammonium cerium (IV) nitrate, etc.; those that generate praseodymium ions include, for example, praseodymium nitrate, praseodymium sulfate, praseodymium oxalate, etc.; and those that generate neodymium ions include, for example, neodymium nitrate, neodymium oxide, etc.

It is preferable that the compound of metal (a) for use in the metal compound component (A) include at least one compound selected from the group consisting of zirconium compounds and yttrium compounds.

In the treatment composition (I), the amount of at least one compound selected from the group consisting of zirconium compounds and yttrium compounds is preferably 10 to 1,000 ppm, more preferably 20 to 500 ppm, and even more preferably 50 to 500 ppm, as the total quantity of metal, on a mass basis.

The metal compound component (A) in the treatment composition (I) may contain, as required, a compound of a metal other than the metal (a).

For example, a compound of at least one metal, wherein the metal is selected from the group consisting of aluminum, alkali metals (lithium, sodium, potassium, rubidium, cesium, and francium) and alkaline earth metals (beryllium, magnesium, calcium, strontium, barium, and radium) may be used as a compound of a metal other than the metal (a). Of these, aluminum compounds are preferred.

Examples of aluminum compounds include aluminium nitrate etc.

In the treatment composition (I), the amount of the compound of a metal other than the metal (a) is preferably 1,000 ppm or less, more preferably 1 to 10,000 ppm, and even more preferably 5 to 5,000 ppm, as the total quantity of metal, on a mass basis.

The preferable combination of metal used in the metal compound component (A) is not limited, but a zirconium compound and a yttrium compound, or a zirconium compound and an aluminum compound are preferably used.

The pH of the treatment composition (I) is preferably 2.5 to 8.0, more preferably 3.0 to 7.5, and even more preferably 3.5 to 7.0. The bath temperature of the treatment composition (I) is usually 5° C. to 45° C., preferably 10° C. to 40° C., and more preferably 20° C. to 35° C.

The film comprising the treatment composition (I) mainly comprises metal oxide, metal fluoride, or metal hydroxide.

1.3 Surface-Treated Metal Substrate Production Process

The surface-treated metal substrate production process of the present invention comprises the steps of immersing a metal substrate for use as a cathode in the above mentioned treatment composition (I), and applying electric current for 10 to 600 seconds by superposing an AC voltage (Va) with a frequency of 0.1 to 1,000 Hz and a peak-to-peak voltage of 1 to 40 V onto a 1 to 50 V DC voltage (Vd).

The DC voltage (Vd) is 1 to 50 V, preferably 5 to 40 V. When the DC voltage is less than 1 V, a film is unlikely to be formed, whereas when the DC voltage is more than 50 V, a film that is not uniform is likely to be formed.

The frequency of the AC voltage (Va) is 0.1 to 1,000 Hz, preferably 0.5 to 500 Hz, more preferably 1 to 400 Hz, and even more preferably 1 to 100 Hz. When the frequency is less than 0.1 Hz, the amount of a film deposited on the metal substrate is likely to decrease, whereas when the frequency is more than 1,000 Hz, a film is unlikely to be formed.

The peak-to-peak voltage of the AC voltage (Va) is 1 to 40 V, preferably 5 to 30 V, and more preferably 5 to 20 V. When the peak-to-peak voltage is less than 1 V, the amount of a film deposited on the metal substrate is likely to decrease, whereas when the peak-to-peak voltage is more than 40 V, a film that is not uniform is likely to be formed.

The duty cycle ($\tau$ (pulse duration)/T (period)) of the AC voltage (Va) is preferably 0.1 to 0.9, and more preferably 0.3 to 0.7. When the duty ratio is within the above range, a more highly dense film can be foiled and is thus preferable.

The duration for applying an electric current is 10 to 600 seconds, preferably 30 to 120 seconds. When the duration for applying an electric current is less than 10 seconds, the amount of a film deposited on the metal substrate is likely to decrease, whereas when the duration for applying an electric current is more than 600 seconds, a film that is not uniform is likely to be formed.

According to the production process of the present invention, a film that is about 1 to about 300 mg/m$^2$ (on a metal basis) can be formed on the metal substrate. From the standpoint of coating cost, and corrosion resistance and finish of the film after coating, it is preferable to set the deposition content to about 25 to about 150 mg/m$^2$ (on a metal basis), and more preferably about 40 to about 120 mg/m$^2$ (on a metal basis), by suitably adjusting the duration for applying an electric current.

With or without washing with water, the resulting film is subjected to setting at room temperature (less than 40° C.) for 10 seconds to 600 minutes, or dried by heating at 40° C. to 180° C. for 1 minute to 40 minutes. The film of the present invention is thus prepared.

In the present invention, by superposing an AC voltage (Va) with a frequency of 0.1 to 1,000 Hz and a peak-to-peak voltage of 1 to 40 V onto a 1 to 50 V DC voltage (Vd), a metal substrate of superior corrosion resistance and finish after coating can be obtained in a short period of treatment, compared to an electrolytic treatment using a conventional cathode electrolytic method (direct-current electrolytic method). This is because when an AC voltage (Va) is applied to the metal substrate under cathode bias, the surface of the metal substrate is activated, which allows a film obtained by electrolytic treatment using the treatment composition (I) to be uniformly formed on the metal substrate. Consequently, coated articles obtained by applying a coating composition on the metal substrate on which the treated film has been formed are excellent in corrosion resistance and finish.

Further, the film obtained from the treatment composition (I) is a uniform, high-dense film (several tens or hundreds of nm) with few cracks. Such a film is considered to contribute to inhibiting the corrosion of the metal substrate under the coating film because it blocks corrosion-promoting substances (e.g., $O_2$, $Cl^-$, $Na^+$.

1.4 Others

From the standpoint of corrosion resistance, the surface-treated metal substrate obtained by the process of the invention preferably includes an additional coating film on the film obtained from the treatment composition (I).

The coating composition used herein is not particularly limited, and may be an organic-solvent coating composition, an aqueous coating composition, a powder coating composition, etc.

Preferable examples of coating compositions include commercially available coating compositions. Such compositions generally include a resin, a curing agent, a curing catalyst, and, if necessary, a surfactant, a surface-adjusting agent, and other additives.

Examples of resins for use in the coating composition include epoxy resins, acrylic resins, polyester resins, alkyd resins, silicone resins, fluororesins, etc.

Examples of curing agents for use in the coating composition include room temperature-curable curing agents and heat-curable curing agents, as well as ultraviolet ray-curable curing agents, and electron beam-curable curing agents, each of which containing a polyisocyanate compound and/or an amino resin.

Of these, it is preferable to use conventionally known cationic electrodeposition coating compositions that contain an amine-added epoxy resin, as compositions that generate a film excellent corrosion resistance and finish, which are the same as the goal of the invention.

Hereinbelow, cationic electrodeposition coating compositions that contain an amine-added epoxy resin are detailed.

Examples of such amine-added epoxy resins include polyamine resins that are generally used in an electrode coating composition, such as (i) an adduct of a polyepoxide compound with a primary mono- or polyamine, a secondary mono- or polyamine, or a primary/secondary mixed polyamine (see, for example, the description of U.S. Pat. No. 3,984,299);

(ii) an adduct of a polyepoxide compound with a secondary mono- or polyamine having a ketiminized primary amino group (see, for example, the description of U.S. Pat. No. 4,017,438); and (iii) a reaction product obtained by etherification of a polyepoxide compound with a hydroxy compound having a ketiminized primary amino group (see, for example, Japanese Patent Publication No. S59-43013).

The amine value of the amine-added epoxy resin is not particularly limited, but is preferably 30 to 70 mgKOH/g, and more preferably 40 to 70 mgKOH/g. The number average molecular weight of amine-added epoxy resin is preferably 1,000 to 10,000, and more preferably 2,000 to 5,000.

In addition to the amine-added epoxy resin, the cationic electrodeposition coating composition may contain a curing agent, a curing catalyst, and various additives.

Examples of curing agents for use in the cationic electrodeposition coating composition include blocked polyisocyanate compounds, such as aromatic, aliphatic, or alicyclic polyisocyanate compounds.

Specific examples of aromatic polyisocyanate compounds include 1,3- or 1,4-phenylene diisocyanate, 2,4- or 2,6-tolylene diisocyanate (TDI), crude TDI, 2,4'- or 4,4'-diphenylmethane diisocyanate (MDI), 4,4'-diisocyanatobiphenyl, 3,3'-dimethyl-4,4'-diisocyanatobiphenyl, 3,3'-dimethyl-4,4'- diisocyanatodiphenylmethane, crude MDI [polymethylenepolyphenylisocyanate], 1,5-naphthylenediisocyanate, 4,4',4"-triphenylmethane triisocyanate, m- or p-isocyanatophenylsulfonyl isocyanate, etc.

Usable aliphatic polyisocyanate compounds include, for example, ethylene diisocyanate, tetramethylene diisocyanate, hexamethylene diisocyanate (HDI), p-xylene diisocyanate (XDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, 2-isocyanatoethyl-2,6-diisocyanato hexanoate, etc.

Usable alicyclic polyisocyanate compounds include, for example, isophorone diisocyanate (IPDI), dicyclohexylmethane-4,4'-diisocyanate (hydrogenated MDI), α,α,α',α'-tetramethylxylylenene diisocyanate (TMXDI), cyclohexylene diisocyanate, etc.

A blocking agent is added to the polyisocyanate compounds to block the isocyanate groups in the compounds. Examples of blocking agents include lactam compounds such as ϵ-caprolactam, etc.; oxime compounds such as methyl ethyl ketoxime, cyclohexanoxime, etc.; aromatic alkylalcohols such as phenylcarbinol, methylphenylcarbinol, etc.; ether alcohol compounds such as ethylene glycol monobutyl ether etc.

The amount of the curing agent is not limited and can be suitably determined based on the composition of the coating composition. The curing agent is preferably added in an amount of 10 to 70 parts by mass, more preferably 25 to 50 parts by mass, per 100 parts by mass of amine-added epoxy resin.

The neutralization and aqueous dispersion of amine-added epoxy resin are generally performed by adding a curing agent such as a blocked polyisocyanate compound etc., a surfactant, a surface-adjusting agent, a curing catalyst, and other additives, and then neutralizing them with aliphatic carboxylic acids including water-soluble organic acids such as acetic acid, formic acid, lactic acid, etc. An emulsion is thus obtained.

The cationic electrodeposition coating composition is obtained by adding to the emulsion, a pigment dispersion paste, and optionally, an additive and a neutralizer; diluting with deionized water or the like; and then adjusting the bath solid concentration to about 5 to 40 mass %, preferably 10 to 25 mass %, and adjusting the pH to about 1.0 to 9.0, preferably 3.0 to 7.0.

Such a pigment dispersion paste can be produced by adding a resin for dispersion and deionized water together with a pigment and an organic tin compound as a curing catalyst, and by dispersing them using a ball mill, sand mill, etc. If necessary, the pigment dispersion paste may contain a neutralizer.

Examples of pigments include organic or inorganic coloring pigments; extender pigments, such as kaolin, baryta powder, precipitated barium sulfate, barium carbonate, calcium carbonate, gypsum, clay, silica, white carbon, diatomaceous earth, talc, magnesium carbonate, alumina white, gloss white, mica powder, etc.; and rust preventive pigments, such as aluminum tripolyphosphate, zinc tripolyphosphate, zinc white, inorganic bismuth, organic bismuth, etc. Examples of organic tin compounds include dibutyltin oxide (DBTO), dioctyltin oxide (DOTO), etc.

Examples of resins for dispersion include tertiary amine epoxy resins, quaternary ammonium salt epoxy resins, tertiary amine acrylic resins, and the like.

In the process of the present invention, since the film obtained from the treatment composition (I) can prevent the corrosion of the metal substrate under the coating film, corrosion resistance is ensured even when a reduced amount of rust preventive pigment or curing catalyst is used, or the use thereof is omitted. Accordingly, this process is effective in reducing the cost of coated articles.

Therefore, if a rust preventive pigment is added, the amount thereof is preferably 30 parts by mass or less, more preferably 0.1 to 30 parts by mass, and even more preferably 1 to 10 parts by mass, per 100 parts by mass of amine-added epoxy resin. The curing catalyst is preferably added in an amount of 20 parts by mass, more preferably 0.01 to 20 parts by mass, and even more preferably 0.1 to 10 parts by mass, per 100 parts by mass of amine-added epoxy resin.

The composition may be coated by any methods. For example, dip coating, shower coating, spray coating, roll coating, electrocoating, and other known methods can be used.

A preferred embodiment of the present invention, i.e., an embodiment of performing electrodeposition coating using a cationic electrodeposition coating composition as a coating composition will be explained below.

A coating film may be formed on the film obtained from the treatment composition (I) by immersing the metal substrate that contains the film obtained from the treatment composition (I) in an electrodeposition bath filled with a cationic electrodeposition coating composition, and applying an electric current at a voltage of 50 to 400 V, preferably 100 to 370 V, more preferably 150 to 350 V, for 60 to 600 seconds, preferably 120 to 480 seconds, and more preferably 150 to 360 sec. Applying an electric current in the above-mentioned range is preferable in view of the finish and throwing power.

An electric current is applied to the bath containing the cationic electrodeposition coating composition under the following conditions: an inter-electrode distance of 0.1 to 5 m, preferably 0.1 to 3 m, and more preferably 0.15 to 1 m, and an anode/cathode ratio of 1/8 to 2/1, and preferably 1/5 to 1/2.

The bath temperature of the cationic electrodeposition coating composition is usually in the range of 5° C. to 45° C., preferably 10° C. to 40° C., and more preferably 20° C. to 35° C.

After the electrodeposition coating, in order to remove an excess of the cationic electrodeposition coating composition, washing is thoroughly performed using water, such as ultrafiltrate (UF filtrate), reverse osmosis permeate (RO water), industrial water, pure water, or the like so that no cationic electrodeposition coating composition is left on the surface of coated article.

The baking temperature of the coating film on the surface of the article to be coated is 100° C. to 200° C., and preferably 120° C. to 180° C. The baking time is about 5 to about 90 minutes, and preferably about 10 to about 50 minutes.

The thickness of the dried coating film is preferably 0.1 to 50 μm, and more preferably 1 to 30 μm.

2. Metal Substrate Treatment Process

The present invention relates to a metal substrate treatment process comprising immersing a metal substrate as a cathode in a treatment composition (I), and applying an electric current for 10 to 600 seconds by superposing an AC voltage (Va) with a frequency of 0.1 to 1000 Hz and a peak-to-peak voltage of 1 to 40 V onto a 1 to 50 DC voltage (Vd).

Regarding the substrate, treatment composition (I), DC voltage, AC voltage, electric current-application time, etc., any of those described above can be employed.

Since the metal substrate that is treated by the metal substrate treatment process of the present invention includes the film obtained from the treatment composition (I), it is excellent in corrosion resistance and finish. Coated articles comprising such a metal substrate also have excellent corrosion resistance and finish.

3. Coated Article Containing a Metal Substrate

Since the thus-obtained metal substrate of the present invention contains the film obtained from the treatment composition (I), it has excellent corrosion resistance and finish. A coated article that comprises such a metal substrate also has excellent corrosion resistance and finish. Examples of coated articles include building materials, electric products, office equipment, automobile bodies and parts, etc.

EXAMPLES

The present invention will be described in more detail below by way of Examples, which are not intended to limit the invention. Note that parts and percentages are by mass.

Preparation of a Treatment Composition

Production Example 1

Preparation of treatment composition No. 1

1,000 parts of deionized water was added to 0.27 parts of zirconium fluoride ammonium, thereby obtaining a treatment composition No. 1. The pH of the treatment composition No. 1 was 6.5.

Production Examples 2 and 3

Preparation of Treatment Compositions Nos. 2 and 3

Treatment compositions Nos. 2 and 3 were prepared in the same manner as in Production Example 1, except that the components and the pH of treatment compositions shown in Table 1 were used.

TABLE 1

| | | Production Example 1 | Production Example 2 | Production Example 3 |
|---|---|---|---|---|
| Treatment composition | | No. 1 | No. 2 | No. 3 |
| Component | Zirconium ammonium fluoride | 0.27 | 0.27 | 0.27 |
| | Aluminum nitrate enneahydrate | | 0.69 | |
| | Yttrium nitrate hexahydrate | | | 0.11 |
| | Deionized water | 1,000 | 1,000 | 1,000 |
| pH of treatment composition | | 6.5 | 6.0 | 6.5 |

With respect to the proportions of the components, the numerals are expressed in parts by mass.

Preparation of Cationic Electrodeposition Coating Composition

Production Example 4

Production Example of Base Resin Solution No. 1)

In a separable flask with an internal volume of 2 liters that was equipped with a thermometer, a reflux condenser, and a stirrer, 390 parts of bisphenol A and 0.2 parts of dimethylbenzylamine were added to 1,010 parts of jER828EL (trade name of an epoxy resin produced by Japan Epoxy Resin Co., Ltd.), and allowed to react at 130° C. until the epoxy equivalent became 800.

Next, 160 parts of diethanolamine and 65 parts of ketimine of diethylenetriamine were added, and allowed to react at 120° C. for 4 hours. Thereafter, 355 parts of ethylene glycol monobutyl ether was added thereto, thereby obtaining the base resin solution No. 1 with a resin solids content of 80 mass %. The base resin solution No. 1 had an amine value of 67 KOH/g, and a number average molecular weight of 2,000.

Production Example 5

Production Example of Curing Agent No. 1

270 parts of Cosmonate M-200 (trade name of crude MDI produced by Mitsui Chemicals, Inc.) and 130 parts of methyl isobutyl ketone were added to a reactor and heated to 70° C. 240 parts of ethylene glycol monobutyl ether was added thereto dropwise over 1 hour, and the mixture was heated to 100° C. The mixture was sampled over time while the temperature was maintained; when the disappearance of absorption by unreacted isocyanate groups was observed by infrared absorption spectrometry, the curing agent No. 1 with a resin solids content of 80% was obtained.

Production Example 6

Production Example of Emulsion No. 1

87.5 parts (solids content: 70 parts) of the base resin solution No. 1 obtained in Production Example 4, 37.5 parts (solids content: 30 parts) of the curing agent No. 1 obtained in Production Example 5, and 11 parts of 10% formic acid were mixed and uniformly stirred. Thereafter, 158 parts of deionized water was added dropwise over about 15 minutes with vigorous stirring to thereby obtain an emulsion No. 1 with a solids content of 34%.

Production Example 7

Production Example of Resin for Pigment Dispersion 1,010 parts of jER828EL (trade name of an epoxy resin produced by Japan Epoxy Resin Co.) was blended with 390 parts of bisphenol A, 240 parts of PLACCEL 212 (trade name of polycaprolactonediol, weight average molecular weight of about 1,250, produced by Daicel Chemical Industries) and 0.2 parts of dimethylbenzylamine, and the mixture was allowed to react at 130° C. until the epoxy equivalent became about 1,090.

Next, 134 parts of dimethylethanolamine and 150 parts of a 90% aqueous lactic acid solution were added to the mixture, and the mixture was allowed to react at 120° C. for 4 hours. Methyl isobutyl ketone was subsequently added to adjust the solids content, thereby obtaining an ammonium salt-type resin for pigment dispersion having a solids content of 60%. The ammonium salt-type resin for pigment dispersion had an ammonium salt concentration of 0.78 mmol/g.

Production Example 8

Production Example of Pigment Dispersion Paste 8.3 parts (solids content: 5 parts) of the resin for pigment dispersion having a solids content of 60% obtained in Production Example 7, 14.5 parts of titanium oxide, 7.0 parts of refined clay, 0.3 parts of carbon black, 1 part of dioctyltin oxide, 1 part of bismuth hydroxide, and 20.3 parts of deionized water were added into a ball mill and dispersed for 20 hours, thereby obtaining a pigment dispersion paste with a solids content of 55%.

Production Example 9

294 parts (solids content: 100 parts) of emulsion No. 1 obtained in Production Example 6, 52.4 parts (solids content: 28.8 parts) of a 55% pigment dispersion paste obtained in Production Example 8, and 297.6 parts of deionized water were added to obtain a cationic electrodeposition coating composition with a solids content of 20%.

Example 1

A cold rolled steel sheet (70×150×0.8 mm) was washed using a degreaser (FINECLEANER 4360 produced by Nihon Parkerizing Co., Ltd.), and then immersed in a bath containing the treatment composition No. 1 adjusted to 28° C.

Next, the cold rolled sheet steel was connected to the cold power supply side, and a counter electrode (made of platinum) was connected to the hot power supply side. AC voltage in which a rectangular wave form having a period of 1 second (frequency: 1 Hz) and a peak-to-peak voltage of 2 V was superposed to a 3 V DC voltage, was applied for 120 seconds. For the AC voltage, a function generator (WF1974, produced by NF Corporation) and a high-speed bipolar power supply (BP-4610, produced by NF Corporation) were used as a source of signal and a power amplifier, respectively.

Subsequently, the cold rolled steel sheet on which the treatment composition No. 1 had been deposited was washed with water, and then drained and dried by air-blowing at room temperature, thereby obtaining a surface-treated plate No. 1, which had a film obtained from the treatment composition No. 1. Using an X-ray fluorescence spectrometer (trade name: RIX-3100, produced by Rigaku Corporation), the amount of zirconium attached on the surface of the treated plate was measured as 40 mg/m$^2$ on a metal basis.

Examples 2 to 9

Surface-treated plates Nos. 2 to 9 were obtained in the same manner as in Example 1, except that the treatment compositions and conditions for applying an electric current employed were those shown in Table 2.

TABLE 2

| | | | Ex. 1 | Ex. 2 | Ex. 3 | Ex. 4 | Ex. 5 | Ex. 6 | Ex. 7 | Ex. 8 | Ex. 9 |
|---|---|---|---|---|---|---|---|---|---|---|---|
| Surface-treated plate | | | No. 1 | No. 2 | No. 3 | No. 4 | No. 5 | No. 6 | No. 7 | No. 8 | No. 9 |
| Treatment composition | | | No. 1 | No. 1 | No. 1 | No. 1 | No. 1 | No. 1 | No. 1 | No. 2 | No. 3 |
| Condition for applying an electric current | Direct voltage (vd) | | 3 | 5 | 5 | 5 | 5 | 20 | 30 | 5 | 5 |
| | Alternating voltage | Peak-to-peak voltage (Va) | 2 | 6 | 10 | 10 | 10 | 10 | 10 | 10 | 10 |
| | | Period (sec) | 1 | 1 | 1 | 0.1 | 1 | 1 | 1 | 1 | 1 |
| | | Frequency (Hz) | 1 | 1 | 1 | 10 | 1 | 1 | 1 | 1 | 1 |
| | | Duty cycle | 0.5 | 0.5 | 0.5 | 0.5 | 0.7 | 0.5 | 0.5 | 0.5 | 0.5 |
| | Duration for applying an electric current (sec) | | 120 | 60 | 60 | 60 | 60 | 60 | 60 | 60 | 60 |
| Amount of treated film (mg/m$^2$) | | | 40 | 45 | 52 | 58 | 57 | 67 | 72 | 58 | 64 |
| Corrosion resistance | | | B | B | B | B | B | B | B | A | A |
| Exposure resistance | | | B | B | B | B | B | B | B | A | A |
| Finish | | | B | B | B | B | B | B | B | A | A |

Comparative Examples 1 to 9

Surface-treated plates Nos. 10 to 18 were obtained in the same manner as in Example 1, except that the treatment compositions and the conditions for applying an electric current employed were those shown in Table 3.

Thereafter, NEO AMILAC 6000 (trade name of a heat-curable topcoat composition produced by Kansai Paint Co., Ltd.) was sprayed over the intermediate coating films to a cured film thickness of 35 μm. Baking was then conducted using an electric hot air dryer at 140° C. for 30 minutes, thereby obtaining exposure test plates Nos. 1 to 18.

TABLE 3

| | | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 |
|---|---|---|---|---|---|---|---|---|---|---|---|
| Surface-treated plate | | | No. 10 | No. 11 | No. 12 | No. 13 | No. 14 | No. 15 | No. 16 | No. 17 | No. 18 |
| Treatment composition | | | No. 1 | No. 1 | No. 1 | No. 1 | No. 1 | No. 1 | No. 1 | No. 2 | No. 3 |
| Condition for applying an electric current | Direct voltage (Vd) | | 0 | 0 | 5 | 5 | 20 | 20 | 50 | 5 | 5 |
| | Alternating voltage | Peak-to-peak voltage (Va) | 3 | 20 | 10 | 0 | 0 | 0 | 0 | 0 | 0 |
| | | Period (sec) | 1 | 1 | $5 \times 10^{-4}$ | | | | | | |
| | | Frequency (Hz) | 1 | 1 | 2000 | — | — | — | — | — | — |
| | | Duty cycle | 0.5 | 0.5 | 0.5 | — | — | — | — | — | — |
| | Duration for applying an electric current (sec) | | 60 | 60 | 60 | 60 | 60 | 120 | 60 | 60 | 60 |
| Amount of treated film (mg/m$^2$) | | | 2 | 5 | 10 | 31 | 43 | 55 | 51 | 49 | 32 |
| Corrosion resistance | | | D | D | D | D | D | B | B | C | C |
| Exposure resistance | | | D | D | D | D | D | B | B | D | D |
| Finish | | | C | C | D | B | C | C | C | C | C |

Surface-treated plates Nos. 1 to 18 obtained by the above procedure were subjected to the following evaluations.

Tables 2 and 3 show the results.

Evaluation

Corrosion Resistance Test (1) Preparation of Test Plates Nos. 1 to 18

The cationic electrodeposition coating composition obtained in Example 9 was electrodeposited at 250 V for 3 minutes on the surface-treated plates Nos. 1 to 18 obtained as above, and baked at 170° C. for 20 minutes. Test plates Nos. 1 to 18 each having an electrodeposition coating film thickness of 20 μm were thus obtained.

Using the test plates Nos. 1 to 18, the corrosion resistance test was carried out in the following manner.

(2) Corrosion Resistance Test

Each test plate was cross-cut with a knife so that the cut reached the substrate. Each test plate was then subjected to a salt spray test for 480 hours in accordance with JIS Z-2371. Corrosion resistance was rated based on the width of rust or blister from the cut portion, according to the following criteria:

A: The maximum width of rust or blister from the cut was less than 2.0 mm (on one side).

B: The maximum width of rust or blister from the cut was not less than 2.0 mm and less than 3.0 mm (on one side).

C: The maximum width of rust or blister from the cut was not less than 3.0 mm and less than 4.0 mm (on one side).

D: The maximum width of rust or blister from the cut was not less than 4.0 mm (on one side).

Exposure Resistance Test (1) Production of Exposure Test Plates Nos. 1 to 18

WP-300 (trade name of an aqueous intermediate coating composition produced by Kansai Paint Co., Ltd.) was sprayed over the electrodeposited test plates Nos. 1 to 18 obtained above so that the cured film has a thickness of 25 μm, and then baked at 140° C. for 30 minutes using an electric hot air dryer.

(2) Exposure Resistance Test

The coating films of the exposure test plates Nos. 1 to 18 were cross-cut with a knife so that the cut reached the substrate. The plates were placed flatly and exposed to outside weather conditions in Chikura-machi, Chiba Prefecture, for one year. The exposure resistance was then evaluated, based on the width of rust or blister from the cut portion.

A: The maximum width of rust or blister from the cut was less than 2.0 mm (on one side).

B: The maximum width of rust or blister from the cut was not less than 2.0 mm and less than 3.0 mm (on one side).

C: The maximum width of rust or blister from the cut was not less than 3.0 mm and less than 4.0 mm (on one side).

D: The maximum width of rust or blister from the cut was not less than 4.0 mm (on one side).

Evaluation of Finish

Surface roughness (Ra), which is defined by JIS B 601, of the coating surface of each of the electrodeposited test plates Nos. 1 to 18 obtained above was measured using Surf Test 301 (trade name of a surface roughness measuring instrument produced by Mitsutoyo Corporation) at a cut-off length of 0.8 mm, and evaluated according to the following criteria:

A: The surface roughness value (Ra) was less than 0.15.

B: The surface roughness value (Ra) was not less than 0.15 and less than 0.25.

C: The surface roughness value (Ra) was not less than 0.25 and less than 0.35.

D: The surface roughness value (Ra) was not less than 0.35.

The invention claimed is:

1. A process for producing a surface-treated metal substrate, comprising the steps of:

(i) forming a film on a metal substrate comprising immersing the metal substrate as a cathode in a treatment composition (I), and applying an electric current for 10 to 600 seconds by superposing an AC voltage (Va) with a frequency of 0.1 to 1,000 Hz and a peak-to-peak voltage of 1 to 40 V onto a 1 to 50 V DC voltage (Vd) to obtain the formed film comprising at least one substance selected from the group consisting of a metal oxide, a metal fluoride and a metal hydroxide, and (ii) forming a coating film on the formed film by performing an electrodeposition coating using a cationic electrodeposition coating composition, wherein the treatment composition (I) comprises water and a metal compound component (A) comprising one or more compound(s) of at least one metal (a), wherein the metal (a) is selected from the group consisting of zirconium, titanium, cobalt, vanadium, tungsten, molybdenum, copper, zinc, indium, bismuth, yttrium, iron, nickel, manganese, gallium, silver and lanthanide, and wherein the metal compound component (A) is contained in an amount of 5 to 20,000 ppm in the treatment composition (I), calculated as a total quantity of metal, on a mass basis.

2. The process according to claim 1, wherein the AC voltage (Va) has a rectangular waveform.

3. The process according to claim 2, wherein the AC voltage (Va) has a duty cycle of 0.1 to 0.9.

4. The process according to claim 1, wherein the AC voltage (Va) has a duty cycle of 0.1 to 0.9.

* * * * *